US008658923B2

(12) United States Patent
Weber et al.

(10) Patent No.: US 8,658,923 B2
(45) Date of Patent: Feb. 25, 2014

(54) ELECTRICAL ROTARY SWITCH WITH CLOSING ELEMENTS AT STATIONARY CONTACT LOCATIONS INHIBITING SPARK DISCHARGE AND/OR WITH A LOCKING SPRING MEMBER

(75) Inventors: Ronald Christiaan Weber, Oisterwijk (NL); Maarten Willem Reddering, Oisterwijk (NL)

(73) Assignee: Ewac Holding B.V., Rotterdam (NL)

( * ) Notice: Subject to any disclaimer, the term of this patent is extended or adjusted under 35 U.S.C. 154(b) by 465 days.

(21) Appl. No.: 12/935,585

(22) PCT Filed: Mar. 23, 2009

(86) PCT No.: PCT/EP2009/053366

§ 371 (c)(1), (2), (4) Date: Dec. 9, 2010

(87) PCT Pub. No.: WO2009/121744

PCT Pub. Date: Oct. 8, 2009

(65) Prior Publication Data

US 2011/0259718 A1 Oct. 27, 2011

(30) Foreign Application Priority Data

Apr. 1, 2008 (EP) ..... 08103290

(51) Int. Cl.
*H01H 19/04* (2006.01)

(52) U.S. Cl.
USPC ..... 200/293; 200/11 TC

(58) Field of Classification Search
USPC ..... 200/10, 11 TC, 293; 218/46, 47, 89, 218/145, 158
See application file for complete search history.

(56) References Cited

U.S. PATENT DOCUMENTS 3,590,174 A * 6/1971 Williams, III ..... 200/10
3,715,543 A * 2/1973 Keto et al. ..... 218/117
4,175,220 A * 11/1979 Johnston et al. ..... 200/4

(Continued)

FOREIGN PATENT DOCUMENTS

AT 151234 10/1937
BR 6501329 1/1986

(Continued)

OTHER PUBLICATIONS

International Search Report Issued on Jul. 6, 2009 for PCT Application No. PCT/EP2009/05336 (filing date of PCT application is Mar. 23, 2009).

(Continued)

*Primary Examiner* — Vanessa Girardi
(74) *Attorney, Agent, or Firm* — Steven M. Koehler; Westman, Champlin & Koehler, P.A.

(57) ABSTRACT

A rotary electrical switch comprises a housing having a first rotary contact space for accommodating a rotary contact and a plurality of stationary contact spaces for selectively accommodating at least one stationary contact. The housing comprises one or more closing elements for closing one or more of the stationary contact spaces not in use for accommodating a stationary contact. Another aspect comprises a locking spring member having a first portion being a resilient spring member configured for releasably engaging a locking member, while a second portion is configured for mechanically coupling to a spindle portion for imparting a rotational force on at least one rotary contact of the switch.

12 Claims, 7 Drawing Sheets

(56) References Cited

U.S. PATENT DOCUMENTS

| | | | | |
|---|---|---|---|---|
| 4,335,288 | A | 6/1982 | Ludwig et al. | |
| 4,446,343 | A | 5/1984 | Golub et al. | |
| 4,481,492 | A | 11/1984 | Borne et al. | |
| 4,510,360 | A * | 4/1985 | Golub | 218/117 |
| 4,532,386 | A | 7/1985 | Muench, Jr. et al. | |
| 4,704,659 | A | 11/1987 | Heng et al. | |
| 4,724,287 | A | 2/1988 | Heng et al. | |
| 5,721,449 | A | 2/1998 | Panuce | |
| 5,728,982 | A | 3/1998 | Rao et al. | |
| 5,969,308 | A | 10/1999 | Pever | |
| 6,111,208 | A | 8/2000 | Rochon et al. | |
| 6,222,139 | B1 | 4/2001 | Pandit et al. | |
| 6,265,681 | B1 | 7/2001 | Aromin | |
| D619,547 | S | 7/2010 | Reddering | |
| 8,013,263 | B2 * | 9/2011 | Lindsey | 200/11 TC |
| 2004/0067699 | A1 | 4/2004 | Dumont et al. | |

FOREIGN PATENT DOCUMENTS

| | | | |
|---|---|---|---|
| CN | 1134594 | | 10/1996 |
| CN | 2599728 | | 1/2004 |
| CN | 1722327 | | 1/2006 |
| DE | 1051937 | | 3/1959 |
| EP | 0297055 | | 12/1988 |
| EP | 0420609 | | 4/1991 |
| EP | 0515009 | | 11/1992 |
| EP | 1085542 | | 3/2001 |
| EP | 2107581 | A1 | 10/2009 |
| FR | 1 149 662 | A | 12/1957 |
| FR | 1149662 | | 12/1957 |
| FR | 2886047 | | 11/2006 |
| FR | 2891395 | | 3/2007 |
| GB | 813127 | | 5/1959 |
| GB | 1 159 729 | A | 7/1969 |
| GB | 1159729 | | 7/1969 |
| GB | 1221410 | | 2/1971 |
| GB | 1 485 002 | A | 9/1977 |
| GB | 1485002 | | 9/1977 |
| WO | 2005069328 | | 7/2005 |
| WO | 2005076302 | | 8/2005 |
| WO | 2007036624 | | 4/2007 |
| WO | 2007113197 | | 10/2007 |

OTHER PUBLICATIONS

Communication pursuant to Article 94(3) EPC, mailed Apr. 6, 2011, in connection with European Patent Application No. 08103290.6.

Non-published Design U.S. Appl. No. 29/364,004, filed Jun. 17, 2010.

Chinese Office Action dated Dec. 10, 2012 in connection with Chinese Patent No. 200980118022.5.

European Search Report, mailed on Jul. 2, 2012 in connection with European Patent Application No. 12163778.9.

Third Party Observation, mailed on Oct. 3, 2012 in connection with European Patent Application No. 20110189915.

Third Party Observation, mailed on Oct. 29, 2012 in connection with European Patent Application No. 20110189915.

Notice of Opposition against European Patent Application 08103290.6, filed on Jan. 22, 2013.

Notice of Opposition (letter), against European Patent Application 08103290.6, mailed on Jan. 22, 2013.

Enclosure I Notice of Opposition against European Patent Application 08103290.6, mailed on Jan. 22, 2013.

Enclosure II Notice of Opposition against European Patent Application 08103290.6, mailed on Jan. 22, 2013.

Enclosure III Notice of Opposition against European Patent Application 08103290.6, mailed on Jan. 22, 2013.

Enclosure IV Notice of Opposition against European Patent Application 08103290.6, mailed on Jan. 22, 2013.

Enclosure V Notice of Opposition against European Patent Application 08103290.6, mailed on Jan. 22, 2013.

Notice of Opposition against European Patent Application 08103290.6, mailed on Jan. 29, 2013.

Notice of Opposition Annex against European Patent Application 08103290.6, mailed on Jan. 29, 2013.

Enclosure I Notice of Opposition against European Patent Application 08103290.6, mailed on Jan. 29, 2013.

Enclosure II Notice of Opposition against European Patent Application 08103290.6, mailed on Jan. 29, 2013.

Enclosure III Notice of Opposition against European Patent Application 08103290.6, mailed on Jan. 29, 2013.

Enclosure IV Notice of Opposition against European Patent Application 08103290.6, mailed on Jan. 29, 2013.

Enclosure V Notice of Opposition against European Patent Application 08103290.6, mailed on Jan. 29, 2013.

Enclosure VI Notice of Opposition against European Patent Application 08103290.6, mailed on Jan. 29, 2013.

Enclosure VII Notice of Opposition against European Patent Application 08103290.6, mailed on Jan. 29, 2013.

Enclosure VIII Notice of Opposition against European Patent Application 08103290.6, mailed on Jan. 29, 2013.

* cited by examiner

ELECTRICAL ROTARY SWITCH WITH CLOSING ELEMENTS AT STATIONARY CONTACT LOCATIONS INHIBITING SPARK DISCHARGE AND/OR WITH A LOCKING SPRING MEMBER

PRIORITY CLAIM TO RELATED APPLICATIONS

This application is a national stage application under 35 U.S.C. §371 of PCT/EP2009/053366, filed 23 Mar. 2009, published as WO 2009/121744 A1 on 8 Oct. 2009, and claiming priority to European Application No. 08103290.6, filed 1 Apr. 2008, which application and publication is incorporated herein by reference and made a part hereof in its entirety, and the benefit of priority of which is claimed herein.

TECHNICAL FIELD

The present disclosure relates to the field of rotary electrical switches, in particular rotary switches for switching high powers.

BACKGROUND

Rotary electrical switches comprising a rotary contact and a number of stationary contacts are known in general. Such switches may comprise a plurality of layers, each layer comprising a rotary contact and a number of stationary contacts, for concurrently switching a plurality of currents.

Electrical rotary switches are predominantly used for switching DC currents. A known problem with DC currents is that when opening a switch by separating the switch contacts a spark builds between the contacts. A spark may also occur when switching off an AC current in a moment of non-zero current flow. The spark produces an explosion-like hot plasma cloud which generally is erosive and conductive. The plasma cloud or spark plume may thus cause damage to nearby objects and/or cause or lead to short-circuiting. The sparks and their effects increase with increasing switched power.

The traditional solution for switching larger powers is to increase the size of the switch. This increases contact distances and thus reduces chances of short circuits due to sparking or voltage creep over surfaces.

Further, a rotary switch typically comprises a rotation control mechanism comprising a locking spring for operably rotating the rotary contact or contacts rapidly between a first position for closing the switch and a second position for opening it. The forces acting on the rotation control mechanism and on the one or more portions therein holding the locking spring may be considerable. These forces may increase when increasing the size of the switch, requiring a stronger construction and/or more material. This adversely affects the ease of operation of the switch.

There is a continuous demand for both increased switchable power and smaller switches. Furthermore, safety requirements tend to become tighter over time.

Consequently, there is a desire for an improved rotary electrical switch.

SUMMARY

An aspect of the invention is a housing for a rotary electrical switch comprising at least one rotary contact and a stationary contact, the stationary contact comprising a contact portion arranged for being contacted by the rotary contact and a connection portion for connecting to a conductor. The housing comprises a first space for accommodating the rotary contact, a second space for accommodating the stationary contact, and a third space for accommodating the stationary contact. At least one of the second space and the third space is substantially closed or closable when the stationary contact is arranged in the third space or the second space, respectively.

Such a housing allows to position the stationary contact in one of the two spaces, whereas the other space is substantially closed or closable. This prevents the spark plume to penetrate into the empty space. Since a stationary contact generally connects a conductor exterior of the switch with the rotary contact on the interior of the switch, the space accommodating the stationary contact generally forms a channel between the interior and the exterior of the switch. Closing off the channel prevents the spark plume to emerge from the switch from the unoccupied space. This increases the safety of the switch and allows to maintain relatively less distance from the switch for positioning other elements, in particular another conductor, more in particular another stationary contact.

The housing may further comprise an electrode. The electrode need not be a contact, and it is preferably not so for security reasons. The electrode may be a piece of metal. The inherent electrical capacitance of the electrode, even if floating, draws at least a portion of the discharge plasma and the heat capacity of the electrode cools the plasma at least partially. The electrode material may also be relatively better resistant to plasma-erosion than other housing material. Thus the adverse effects of the spark discharge are mitigated. The capacitance of a floating electrode may be so low that it conveniently discharges by leaking to the environment over relatively short periods of time between switching events.

Efficiently, the second and/or third space may be substantially closed or closable by the electrode.

The housing may comprise a fourth space in communication with the first space via a first opening for serving as an buffer space or exhaust space for the spark products. The exhaust space may be provided with a second opening at an outside surface of the housing, thus forming a dedicated exhaust channel to the exterior of the switch. The second opening of the channel preferably is located away from an exterior portion of a stationary contact.

In a switch with an electrode, at least a portion of the electrode is preferably arranged or arrangable in the fourth space, possibly at or near the first opening thereof, for at least partially de-ionising and cooling the spark cloud in the exhaust, thus further reducing the effects of the spark on the switch and possibly the exterior thereof.

The second and/or third spaces may be arranged such that a stationary contact fitting that space substantially blocks the communication between the first and fourth spaces, e.g. by closing off the first opening of the fourth space.

Thus, the spark plasma cloud is substantially prevented from exiting the switch housing close to the stationary contact and therewith possibly causing short-circuiting on the exterior of the switch.

The housing may be a first housing module for a modular housing for an electrical rotary switch, wherein the first housing module is stackable to a second housing module, e.g. fastenable by means of a snapping arrangement and/or thermal welding. The second housing module may be a substantially identical module, a mirror inverted module or a module with a different functionality, e.g. a rotation control module. This allows to assemble one or more modular housing to a desired housing.

An aspect of the disclosure is an improved electrical rotary switch, comprising a housing as described above. The switch allows different contact arrangements and can be constructed relatively compact and/or arranged relatively close to other equipment with reduced risks of short circuiting, damage or other adverse effects due to switch-off sparks. The switch is therefore capable of switching relatively high powers. The switch may suitably be modular.

The switch may comprise a plurality of rotary contacts and a modular spindle, the modular spindle comprising at least two spindle portions which are mechanically connected or connectable for each imparting a rotational force on at least one rotary contact of the switch.

The modular spindle facilitates construction of the switch, since relatively shorter spindles may be more easily manipulated. A modular spindle further facilitates construction of a modular switch. The spindle portions may comprise insulating structures and/or may be of insulating material.

An aspect of the disclosure is an electrical rotary switch comprising a housing accommodating at least a first rotary contact and a second rotary contact arranged for being rotatable about an axis of rotation, and at least a first stationary contact and a second stationary contact. The first stationary contact comprises a contact portion arranged for being contacted by the first rotary contact and comprises a connection portion for connecting to a conductor. The second stationary contact comprises a contact portion arranged for being contacted by the second rotary contact and comprises a connection portion for connecting to a conductor. The first and second stationary contacts are arranged offset in the axial direction and the angular direction with respect to the axis of rotation. The first and second rotary contacts are arranged for concurrently contacting the first and second stationary contacts, respectively, in a first rotary orientation about the common axis of rotation.

This allows to concurrently switch two different stationary contacts arranged differently and possibly carrying different currents.

The switch may further have a third and a fourth stationary contact, the third stationary contact comprising a contact portion arranged for being contacted by the first rotary contact concurrently with the first stationary contact, the fourth stationary contact comprising a contact portion arranged for being contacted by the second rotary contact concurrently with the second stationary contact.

In that case the first rotary contact and the second rotary contact may serve as a contact bridges between the first and third contacts and the second and fourth contacts, respectively. Operating the switch by rotating the rotary contacts about the axis of rotation opens or closes both connections.

The contact portion and the connection portion of at least one of the first and second stationary contacts, possibly also of at least one of the third and fourth stationary contacts, are oriented at an angle to each other in at least one of the radial direction and the axial direction with respect to the axis of rotation. This allows to spatially arrange the contact portions and the connecting portions in a desired manner, e.g. for facilitating connecting the conductors to the switch. It also allows to optimise the contacts for the power to be switchable by the switch or a portion thereof.

At least the connection portion of the first stationary contact and the connection portion of the second stationary contact may be arranged substantially perpendicular to each other with respect to the axis of rotation. This separates the contacts relatively far.

In particular when the switch comprises a third and a fourth stationary contact such arrangement allows to maximise the relative distances between the stationary contacts and therewith maximise the power that may be switched by the switch.

The electrical rotary switch may further comprise a shorting member for electrically interconnecting at least the first and second stationary contacts. Thus a current may be switched by at least two switch assemblies of a rotary contact and a stationary contact in series, decreasing the voltage difference to be switched per switch assembly. Alternatively, a current may be switched by at least two switch assemblies in parallel, decreasing the current to be switched per switch assembly. The shorting member may also be used in when the switch comprises the third and fourth contact. For security reasons and/or reasons for mounting the switch, it is preferred that the shorting member fits substantially within the outer boundaries of the switch.

An aspect of the disclosure is a locking spring member configured for an electrical rotary switch comprising at least one rotary contact and at least one stationary contact. The locking spring member comprises a first portion and a second portion. The first portion comprises a resilient spring member configured for releasably engaging a locking member and the second portion is configured for mechanically coupling to a spindle portion for imparting a rotational force on at least one rotary contact of the switch. The second portion is electrically insulating.

The locking spring member generally is of metal for accepting mechanical load and providing a reliable resiliency. The locking member generally is a protruding portion in or of a housing of the rotation control mechanism comprising the locking spring member. Providing the locking spring member with an insulating second portion or connection portion reduces chances of a short circuit from a contact to the spring member, e.g. due to a spark plume, and increases operator safety.

An electrical rotary switch comprising at least one rotary contact and at least one stationary contact, further comprising such a locking spring member is therefore relatively safe.

These and other aspects will hereafter be more fully explained with reference to the drawings showing an embodiment by way of example.

DETAILED DESCRIPTION OF EMBODIMENTS

Figure 1B:
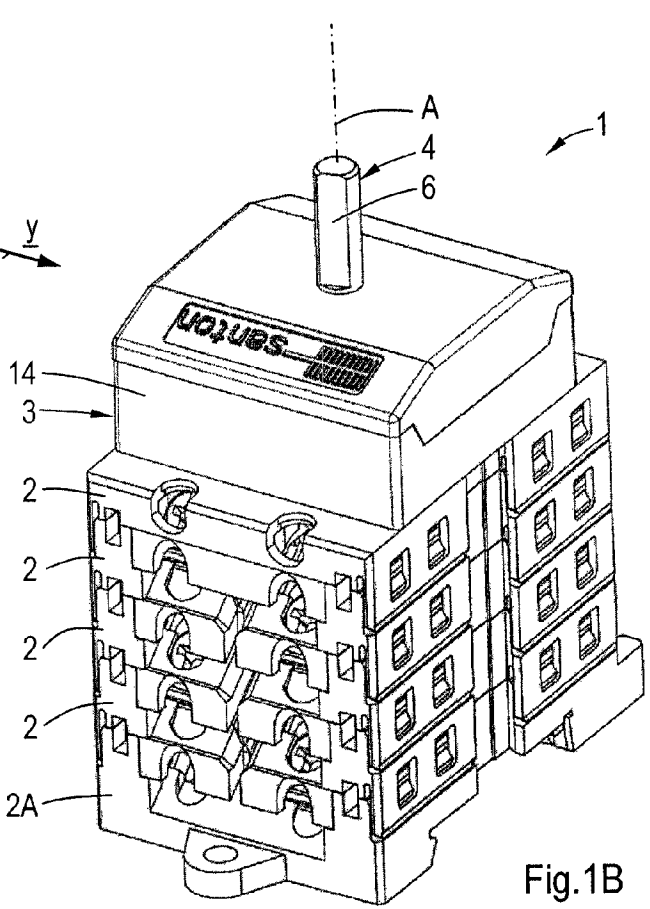
FIGS. 1A and 1B are two perspective views of a modular embodiment of the electrical rotary switch.
Figure 1C:
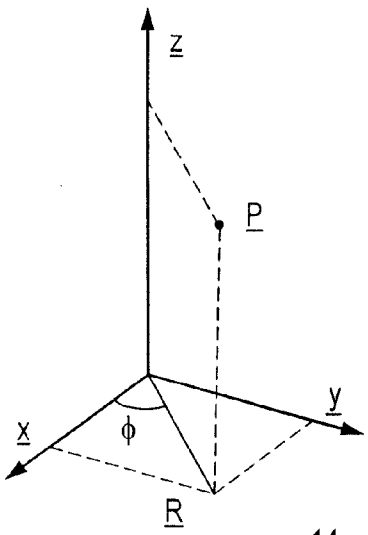
FIG. 1C is a coordinate system for ease of reference.
Figure 1A:
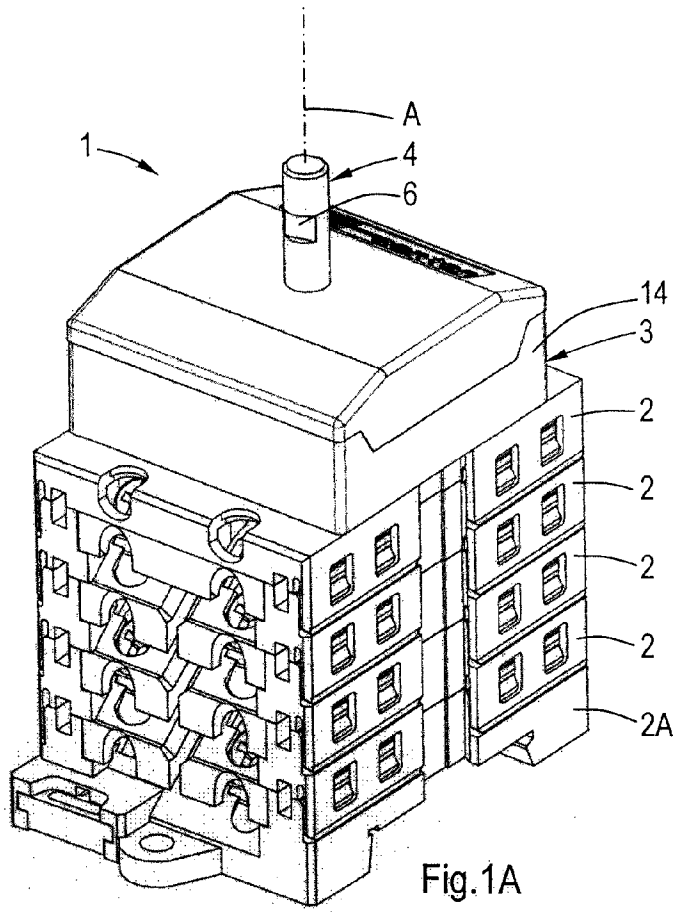
Figure 2:
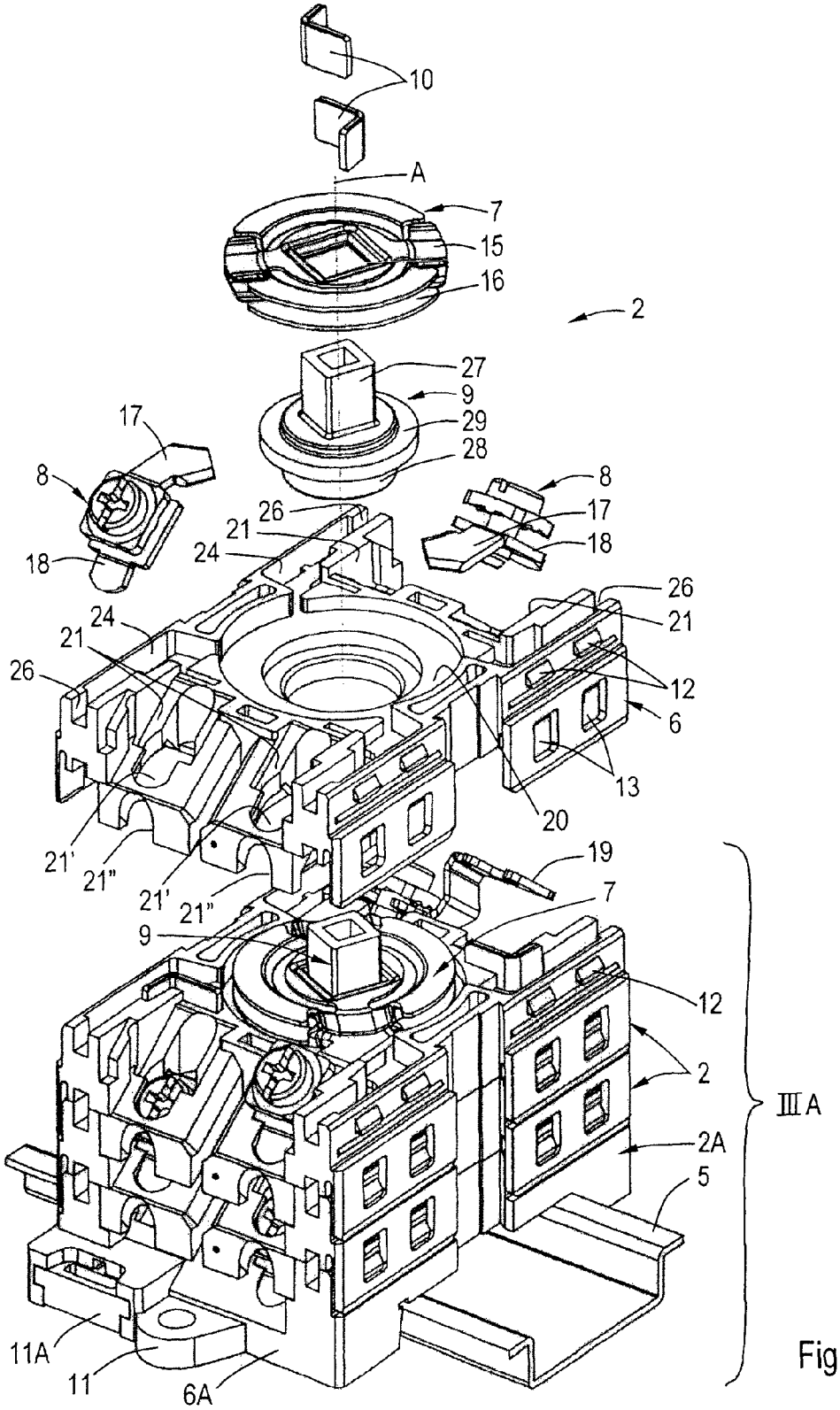
FIG. 2 is partial explosion view of the switch of FIGS. 1A and 1B.

Referring to FIGS. 1A and 1B, there is shown an electrical rotary switch 1. The switch 1 is a modular switch, comprising a plurality of switch modules 2 and a rotation control module 3 stacked together. One of the switch modules 2 is formed as a mounting module 2A, for mounting the switch 1 to an object or an apparatus such as a mounting rail 5 (FIGS. 2, 3). Otherwise, the switch modules 2, 2A are substantially identical. The rotation control module comprises a spindle 4 for operating the switch 1. The spindle is rotatable about an axis of rotation A. For mounting a knob, handle or another operating element to the spindle 4 is provided with flat faces 6. A key, a groove, a screw thread or the like are also conceivable.

For ease of reference in the following, FIG. 1C depicts a standard coordinate frame; the spatial position of a point P may be indicated with reference to the Cartesian coordinates (x, y, z) and/or with reference to the cylindrical coordinates ($\bar{R}$, $\bar{\phi}$, $\bar{z}$). In the switch 1, the axis of rotation A coincides with the $\bar{z}$-axis of the reference coordinate system, compare FIGS. 1A and 1C.

Figure 3B:
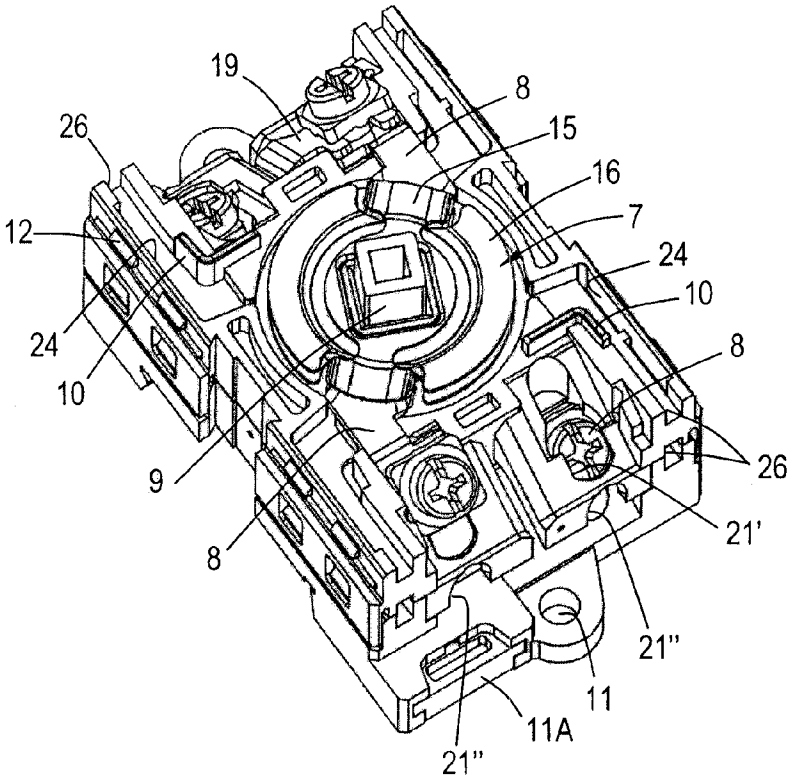
FIG. 3B is a perspective view an assembly of two switch modules.
Figure 3A:
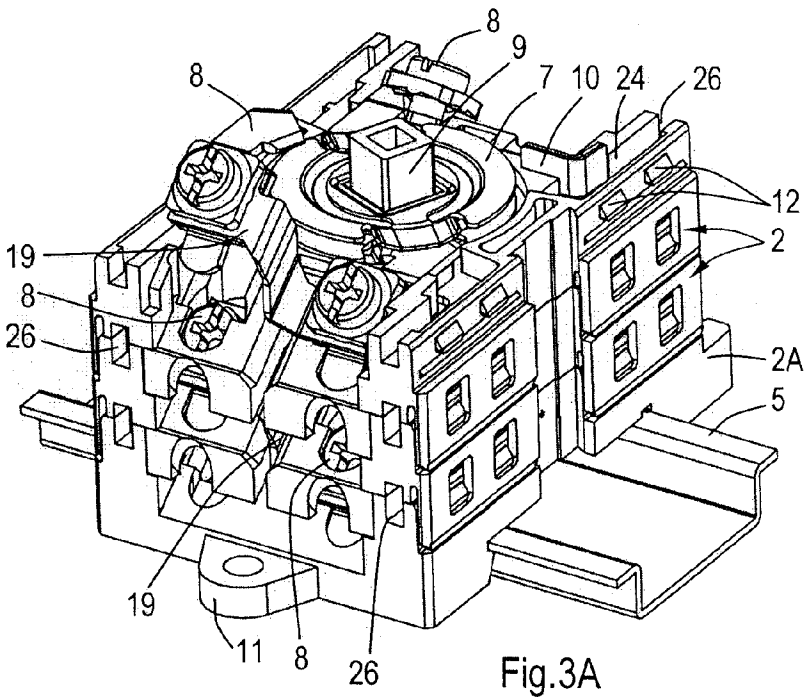
FIG. 3A is a perspective view of the bottom portion marked IIIA in FIG. 2 from another angle

Further referring to FIGS. 2-3B, different views of stacked switch modules 2 are shown. FIG. 2 shows a mounting switch module 2A, two stacked switch modules 2 and an explosive view of a switch module 2. FIG. 3A shows the mounting module 2A and two switch modules 2, as indicated in FIG. 2. FIG. 3B shows a mounting switch module 2A and one switch module 2 stacked thereon.

Each switch module 2, 2A comprises a housing module or generally housing 6, 6A. Each switch module 2, 2A comprises, accommodated in the housing 6, 6A, a rotary contact 7 and two stationary contacts 8, a spindle module 9 and two optional electrodes 10. The switch module 2, 2A may comprise more or less stationary contacts 8.

The housing modules 6, 6A of the switch modules 2, 2A are substantially identical apart from mounting fixtures 11, 11A such as through holes. Unless where indispensable, in the following there will be made no difference between a mounting switch module 2A and another switch module 2.

The switch modules 2 of the switch 1 are fastened together. In the shown embodiment, the housing modules 6 comprising a fastening arrangement in the form of snapping latches 12 and corresponding recesses or windows 13. The modules 2 are fastened by stacking them on top of each other and snapping the latches 12 of each housing module 2 into the windows 13 of an adjacent module 2. Other fastening arrangements such as bolting, using gluing and/or welding techniques may be suitably provided.

As will be discussed in more detail later, the rotation control module 3 also comprises a housing 14 with a fastening arrangement corresponding with that of the switch modules 2. The housings 6, 6A and 14 together form the housing of the switch 1. The housings preferably are insulating, possibly of a plastic or plastic coated material.

The rotary contact 9 comprises a conductive portion 15 and an optional insulating portion 16.

The stationary contacts 8 comprise a contact portion 17 arranged for being contacted by at least the conductive portion 15 of the rotary contact 7 and a connection portion 18 for connecting to a conductor, e.g. a conductor of a cable (not shown). Here the connection portion 18 comprises a screw clamp, but other fastening or connecting arrangements may be provided.

Stationary contacts 8 of adjacent switch modules may be interconnected with a shorting member 19, to be discussed later.

Here, the rotary contact 7 forms a contact bridge which may be positioned in one rotational orientation (rotation about one angle $\phi$) with respect to the axis of rotation A for contacting two opposing stationary contacts 8 and closing the switch. As explained in more detail below, in another rotary position (rotated to a different angle $\phi'$), the contact is broken and the switch is open. When open, the rotary contact is preferably oriented perpendicularly to its "closed" orientation, being rotated by approximately 90 degrees in the $\underline{\phi}$ direction.

Figure 4B:
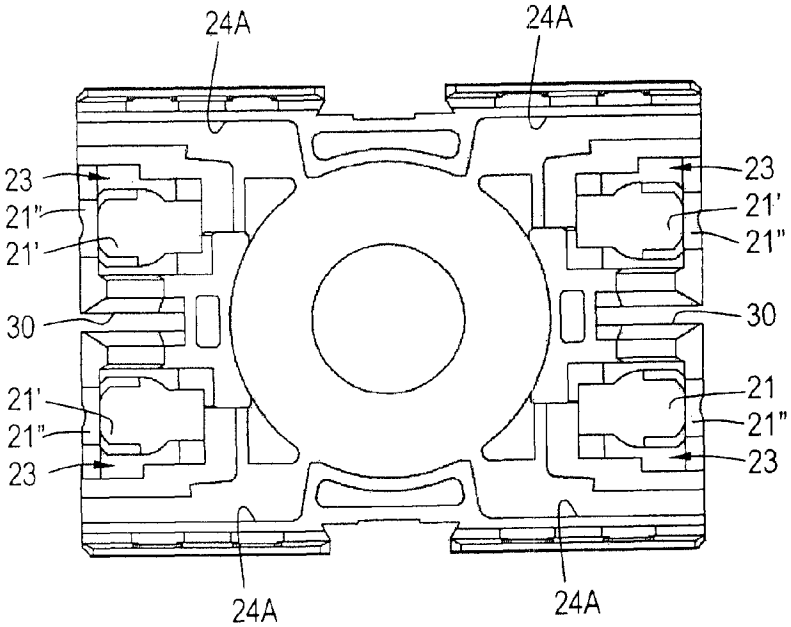
FIG. 4B is a plan bottom view of a housing module.
Figure 4A:
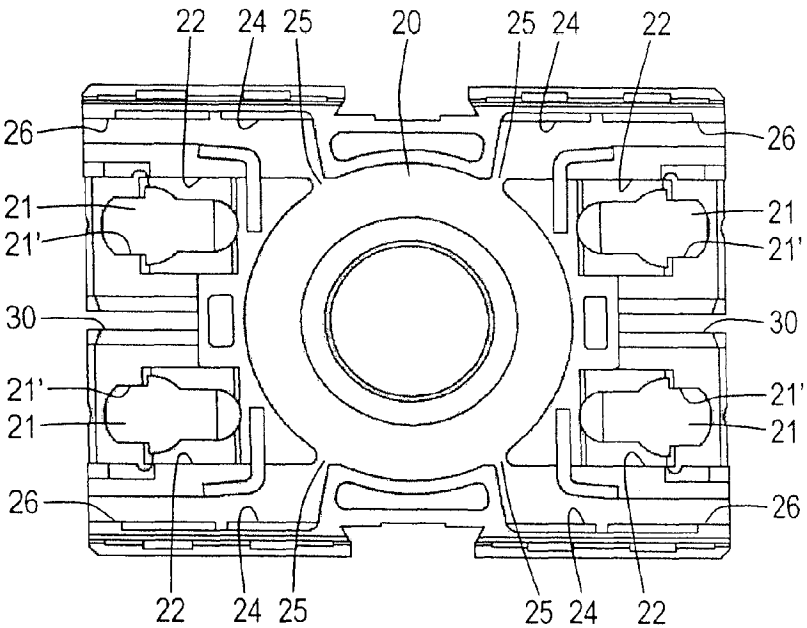
FIG. 4A is a plan top view of a housing module.

Accordingly, also referring to FIGS. 4A and 4B, the housing 6 comprises a space 20 for accommodating the rotary contact 7 rotatably about the axis of rotation A.

The housing 6 further comprises four portions 21 for accommodating a stationary contact 8 such that its contact portion 17 protrudes into the space 20, for being contacted by the rotary contact 7, while its connection portion 18 is accessible on the outside of the switch 1, allowing connecting it to a conductor.

Each portion 21 comprises a recessed space 22 into which the connection portion 18 of the stationary contact 8 may be fit for stably and substantially immovably accommodating the contact 8. In the present switch 1, the stationary contact 8 is further fixed by a fitting structure 23 in the bottom side of an adjacent housing 6 (see FIG. 4B) when that is attached to the housing 6 holding the stationary contact 8. The spaces 22 and the fitting structure 23 together form a stationary contact space for accommodating the contact 8 substantially snugly. This stationary contact space forms a stationary contact channel from the space 20 towards the exterior of the switch. The space may also be comprised in one housing 6, the adjacent housing 6 substantially forming a lid without an additional structure.

The portions 21 are further provided with apertures and recesses 21' and 21" allowing access to a lower lying stationary contact 8.

The housing 6 further comprises a plurality of exhaust spaces 24 in communication with the first space 20 via an opening 25. Here the exhaust spaces 24 are exhaust channels, comprising a second opening or exhaust opening 26 at an outside surface of the housing 6. In the present switch 1, corresponding spaces 24A are formed in the bottom of the housing 6 cooperating with the space 24 in the upper side of the lower housing 6, similar to the stationary contact channel referred to above. The exhaust openings 26 are offset from the connecting portions 18 of the stationary contacts 8, directing a spark plume away.

The electrodes 10 are arranged inside the exhaust spaces 24 for discharging and cooling the plasma cloud at least partially.

When a stationary contact 8 is fitted in a portion 21, the stationary contact space or -channel is substantially closed off and a plasma cloud plume is substantially blocked from exiting the switch 1 through the channel. When no stationary contact 8 is fitted, the stationary contact channel is open. This may be undesirable as set out above. In the present embodiment, this is prevented by the electrode 10, which closes off the stationary contact channel and prevents a plasma plume from exiting the switch 1 through the channel. Another closing element than the electrode 10 may be provided. The closing element and the electrode 10 may also be separate or separately arrangeable objects, e.g. in one space or in separate spaces accommodating the objects individually. In an alternative embodiment the closing element may be a break-away portion, e.g. a wall portion of the housing material. This allows to arrange the stationary contacts in a desired manner and still keep the plasma cloud away from (the exterior portions of) the stationary contact or contacts 8.

It should be noted that the space 22 for accommodating a stationary contact 8 may be formed such that a stationary contact 8 fitted in that space 22 closes off partially or completely the first opening 25 of an exhaust space 8 at that side of the housing 6, hindering or preventing a spark plume from exiting there.

As stated, the present switch 1 comprises a plurality of switch modules 2, each comprising a rotary contact 7, two stationary contacts 8 and a spindle module 9. The switch module 2 may comprise more or less stationary contacts 8.

The space 20 accommodates the spindle module 9 for operably rotating the rotary contact 7. The spindle module 9 comprises a shaft portion 27, a connection portion 28 and an optional support portion 29, here being disc-shaped. The rotary contact 7 is mounted to the shaft portion 27 and may be supported by the support portion 29. The shaft portion 27 is shaped for operably imparting a rotational force to the rotary contact 7. Here, the shaft portion 27 has a square cross section fitting a square central aperture in the rotary contact 7. Other matching cross sectional shapes are equally conceivable, e.g. triangular, rectangular, hexagonal, D-shaped etc.

The connection portion 28 of the spindle module 9 is arranged for operably engaging a portion of (the shaft portion 27 of) of the spindle module 9 of an adjacent switch module 2 for at least mechanically connecting adjacent rotary contacts 7 and allowing to operably impart a rotational force thereto (FIG. 2). Here, the connection portion 28 comprises a substantially square hole for receiving at least a portion of a shaft portion 27 (not shown). The hole and/or the shaft portion 27 may comprise attachment structures such as protrusions, latches etc. for fortifying the connection between adjacent spindle modules 9.

By the present arrangement, a single rotation operation will rotate all mechanically connected rotary contacts 7 together, thus switching all connected switching modules 2 substantially concurrently.

The spindle modules 9 preferably are insulating, e.g. made of plastic for electrically insulating adjacent rotary contacts. A disc shaped portion on the spindle, e.g. support portion 29, may increase air and creep distances between conductors and improve the insulation. For reducing or prevention torsion of the modular spindle, at least some of the spindle modules 9, preferably all, may be connected to a common shaft penetrating through the spindle modules 9. The shaft may be of metal or of an insulating material, e.g. glass fiber or carbon fiber.

Figure 5B:
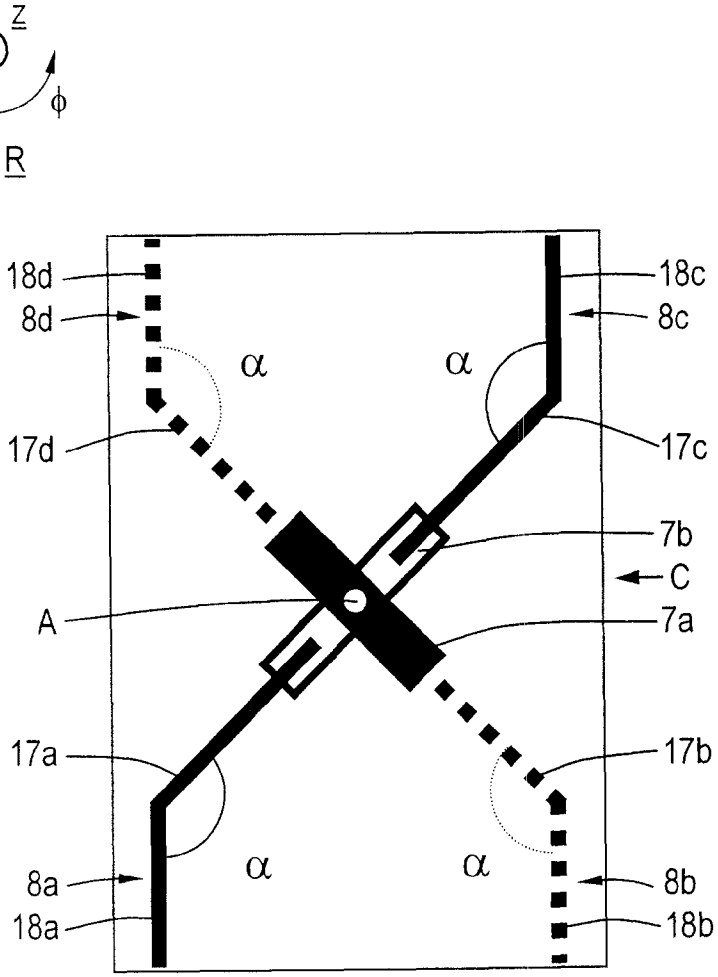
FIGS. 5A and 5B are schematic top views of the contacts in closed (5A) and open (5B) situation of a switch.
Figure 5A:
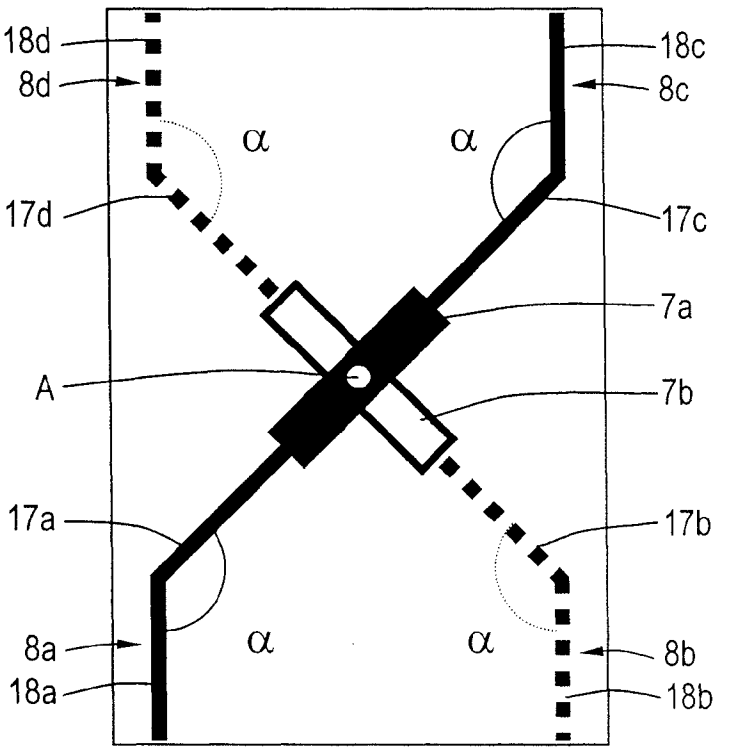
Figure 5C:
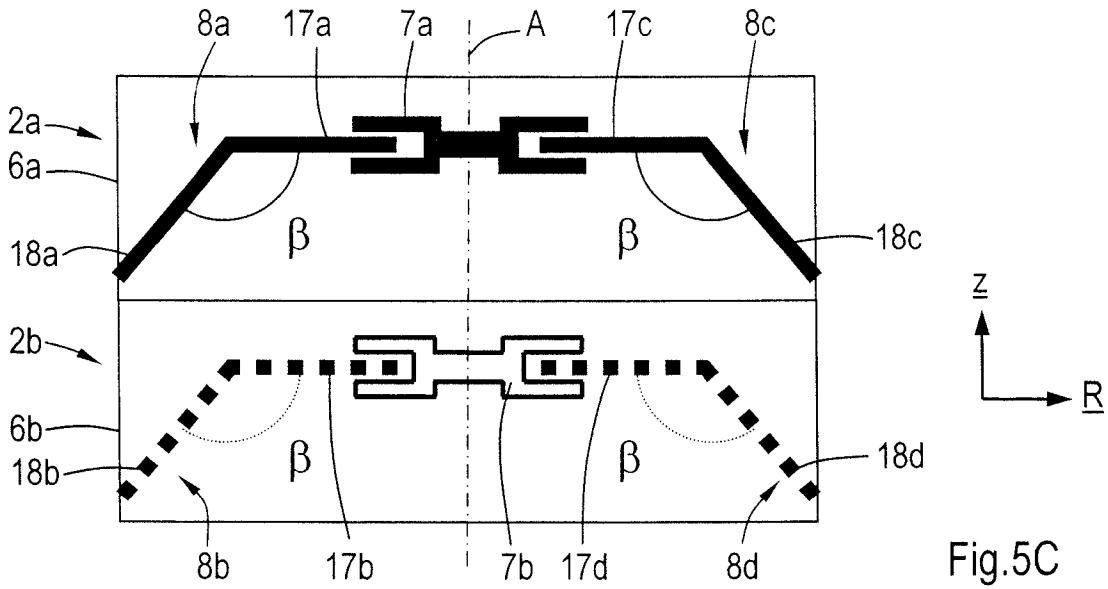
FIG. 5C is a schematic side view of the switch of FIGS. 5A, 5B.

As may be discerned from FIGS. 1-3B, the stationary contacts 8 of adjacent switch modules 2 are arranged offset in the axial direction (z-direction) and in the angular direction ( ϕ-direction) with respect to the axis of rotation A. This is schematically indicated in FIGS. 5A-5C. For ease of reference, a cylindrical coordinate system has been indicated corresponding to the views of FIGS. 5A and 5B and FIG. 5C, respectively.

FIGS. 5A-5C indicate two adjacent switch modules 2*a*, 2*b*. The upper switch module 2*a* comprises a housing 6*a* accommodating a rotary contact bridge 7*a* and two stationary contacts 8*a*, 8*c*. The lower switch module 2*b* likewise comprises a housing 6*b* accommodating a rotary contact bridge 7*b* and two stationary contacts 8*b*, 8*b*.

FIGS. 5A and 5B are top views, FIG. 5C is a side view as indicated next to FIG. 5B.

In FIG. 5A a situation is depicted wherein the rotary contacts 7*a*, 7*b* are arranged in a first position wherein both rotary contacts 7*a*, 7*b* concurrently make electrical contact to (the contact portions 17*a*-17*d* of) the corresponding stationary contacts 8*a*, 8*c* and 8*b*, 8*d* positioned in the housing modules 6*a* and 6*b*, respectively. Thus, both switches 2*a*, 2*b* are closed.

In FIG. 5B, a situation is depicted wherein the rotary contacts 7*a*, 7*b* are arranged in a second position wherein both rotary contacts 7*a*, 7*b* concurrently do not make electrical contact to (the contact portions 17*a*-17*d* of) the corresponding stationary contacts 8*a*, 8*c* and 8*b*, 8*d*, respectively. Thus, both switches 2*a*, 2*b* are open.

The difference is not visible in FIG. 5C.

Since the connection portions 17*a*, 17*c* of the first stationary contacts 8*a*, 8*c* and the connection portions 17*b*, 17*d* of the second stationary contacts 8*b*, 8*b* are arranged substantially perpendicular to each other with respect to the axis of rotation A (in ϕ-direction), the rotary contacts 7*a*, 7*b* may rotate together and concurrently over an angle ϕ of approximately 90 degrees and maintain a near maximum distance of both the contact portions 17*a*, 17*c* and 17*b*, 17*d*, respectively. Thus, the risk of short circuiting within one switch module 2 and from one switch module to an adjacent one is substantially prevented.

In the FIGS. 2-5C, it may also be seen that contact portion 17 and the connection portion 18 of at least one of the first and second stationary contacts are oriented at an angle α to each other in the radial direction (ϕ-direction) and at an angle β in the axial direction (z-direction) with respect to the axis of rotation A. Either angle or a combination thereof allows to optimise the orientation of the contact portion 17 and the connecting portion 18 of the stationary contact 8 with respect to the rotary contact 7, the outer wall of the housing 6 of the switch module 2, an adjacent stationary contact and/or an exhaust opening. Moreover, the angle β enables to position adjacent switch modules relatively close to each other along the axis of rotation A while still allowing relatively large separation between the stationary contacts and allowing access with tools to the connecting portions 18 of the stationary contacts, e.g. with a screw driver.

Such accessibility for tools to the stationary contacts 8 is enhanced by the provision of apertures 21' and 21" discussed above.

Any suitable value of α and β may be chosen. However, preferably, α is in a range between approximately 110-160 degrees, more preferably between approximately 120-150 degrees, most preferably 130-140 degrees, e.g. about 135 degrees. Preferably, β is in a range between approximately 110-170 degrees, more preferably between approximately 120-160 degrees, most preferably 130-150 degrees, e.g. about 140 degrees. The stationary contact need not have only one bending position as indicated in the figures. Different shapes may be contemplated, e.g. substantially C-, S- or Z-shaped contacts in either direction. Different shapes and/or sizes in the radial direction (R-direction) may also be considered.

For increasing switching power, a current may be connected through the switch by connecting conductors to stationary contacts 8*a* (in) and 8*b* (out), for example, and interconnecting or short circuiting the corresponding stationary contacts 8*c*-8*d*. The current will then be switched by both switches in series (2*a*, 2*b*). This halves the voltage difference to be switched per switch module, decreasing the effects of sparking.

Similarly, a current may be connected in parallel to stationary contacts e.g. 8*a* and 8*b* (in) as well as 8*c* and 8*d* (out), for switching in parallel. This maintains the voltage to be switched per switch 2*a*, 2*b*, but halves the power to be transmitted per switch, decreasing the operating load when the switch is closed.

When switching, these arrangement only work reliably, i.e. substantially without damaging or overloading the switch, when both switches 2*a*, 2*b* are switched substantially simultaneously and substantially identically fast. The present arrangement, in particular with angled or crossed contact bridges and stationary contacts allows that.

FIGS. 1-4B show that adjacent portions 21 on both sides of each module 2 are divided by an aperture or slot 30. A shorting member 19 may be provided for electrically interconnecting at the stationary contacts of adjacent switch modules. The shorting member 19 is most clearly visible in FIG. 3A, where a shorting member and a stationary contact attached thereto are shown partially floating. The shorting member 19 is formed to fit the fastening arrangement of the stationary contacts 8.

Due to the slot 30 the shorting member 19 may be fit substantially within the outer perimeter of the switch 1, as defined by imaginary planes covering the outer surfaces of the housing (most clearly visible in FIGS. 3A, 3B), here by having a substantially right-angled "Z"-like shape. Due to this and also due to the slanted portions 21, in accordance with the angle β of the stationary contacts 8, the stationary contact and the shorting member 19 may be substantially inaccessible by hand from the outside. The present switch 1 may thus be formed such that it is substantially safe against an operator touching charged or "live" portions.

This is a substantial improvement over prior art switches, where shorting of two or more switch-units was necessarily done with cables or wires outside of the switch housing. The present switch may therefore be mounted in a relatively smaller volume than a prior art switch for the same power to be switched. One or more shorting members 19 may be provided for connecting any desired number of stationary contacts 8. E.g. a shorting member may also be particularly designed for interconnecting three adjacent stationary contacts 8, such as being formed substantially "}"- or "{"-like. A shorting member comprising a connection portion for assisting or replacing the connection portion of one or more stationary contacts may be envisioned. In a particular embodiment, the shorting member and one or more stationary contacts may be a single integrated device. A shorting member 19 may have a right angled bracket-like shape (resembling "[" or "]") for interconnecting stationary contacts arranged with substantially the same angular position but different axial position with respect to the axis of rotation A, e.g. being substantially directly over each other.

Figure 6:
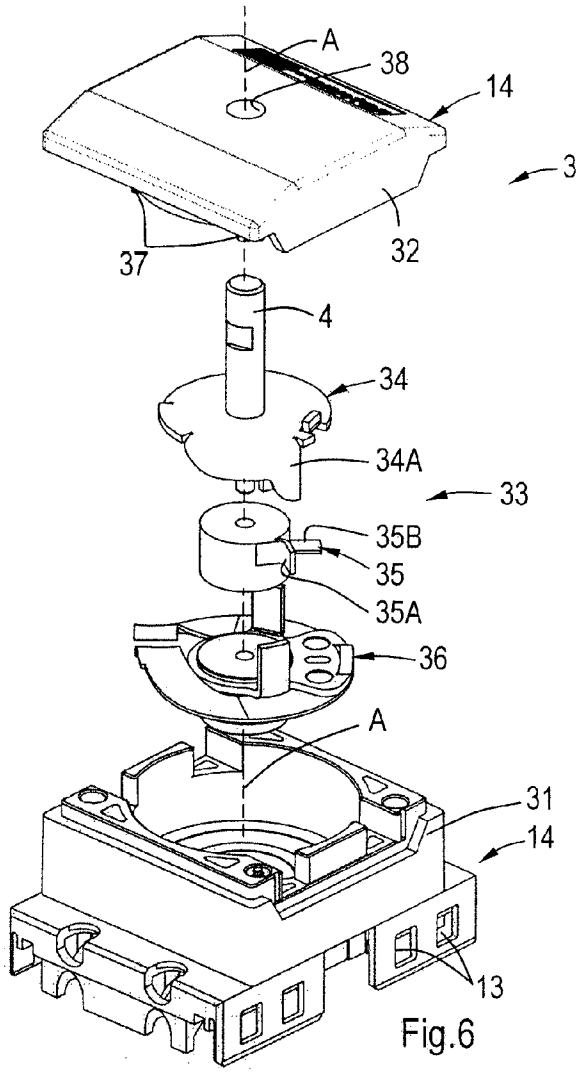
FIG. 6 is an explosion view of a rotation control module of the switch of FIGS. 1A and 1B.

FIG. 6 is an explosion view of the rotation control module 3. The rotation control module comprises a housing 14, in turn comprising a housing body 31 and a lid 32. The housing 14 accommodates the rotation control mechanism 33, which comprises an rotation operation member 34, a rotation spring 35 and a locking spring member 36. On the inside of the lid are four locking protrusions 37. The rotation operation member 34 comprises the spindle 4 for operating the switch 1.

The lid 32 comprises a through hole 38 for the spindle 4. The housing body 31 comprises snapping windows 13 for snapping the module 3 to a switch module 2.

The rotation operation member 34 comprises wings 34A and 34B (not visible behind wing 34A).

The spring member 35 has spring arms 35A, 35B which are connected to a torsion spring.

Figure 7B:
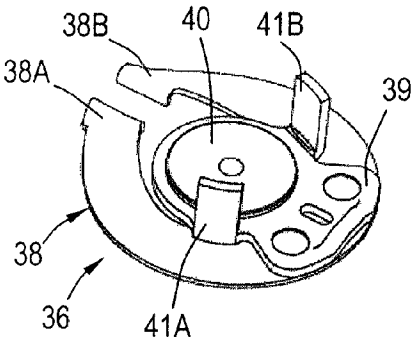
FIGS. 7A, 7B are perspective views of a locking spring member.
Figure 7A:
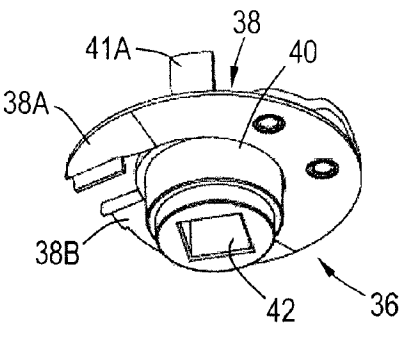
Figure 8B:
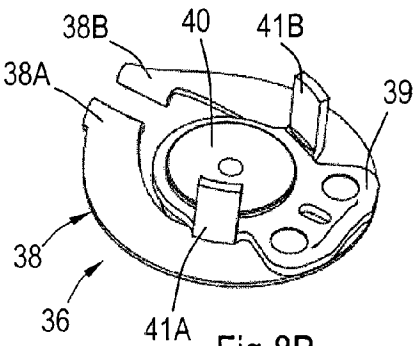
FIGS. 8A, 8B are perspective views of an alternative embodiment of a locking spring member.
Figure 8A:
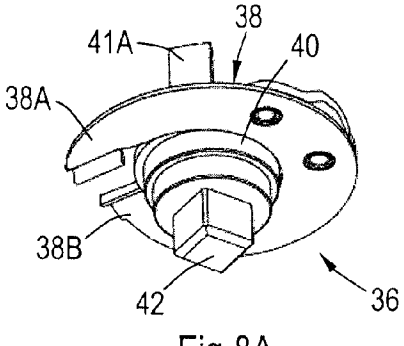

The locking spring member 36 is shown in more detail in FIGS. 7A, 7B. An alternative embodiment is shown in FIGS. 8A, 8B.

The locking spring member 36 comprises a resilient spring member 38, a catch member 39 and a spindle connection portion 40. The spring member 38 comprises spring portions 38A, 38B. The catch member 39 comprises catches 41A, 41B. The spindle connection portion 40 comprises a spindle connection feature 42. In FIGS. 7A, 7B, the spindle connection feature 42 is a square hole for receiving a shaft portion 27 of a spindle module 9, similar to the hole in the connection portions 28 of the above-discussed spindle modules 9. In FIGS. 8A, 8B, the spindle connection feature 42 is a square protrusion for fitting in a connection portion 28 of a spindle module 9. Other mechanical connection mechanisms between the locking spring member 36 and the spindle or a spindle module may be suitably provided.

The general operation of the rotation control mechanism 33 is known per se. When assembled, the spring portions 38 fit around locking protrusion 37 on the inside of the lid 32. The catches 41A, 41B engage the arms 35A, 35B, of the torsion spring 35, which is tensioned.

Upon rotating the spindle 4, e.g. in clockwise direction, the wing 34A of the rotation member 34 engages the spring portion 38A and depresses it. At the same time, the rotation member engages the spring 35 and tensions it further. Upon a spindle rotation of about 80 degrees, the wing 34 has depressed the spring portion 38 so far that it snaps behind the locking protrusion 37 on the inside of the lid 32 freeing the locking spring member 36 to rotate rapidly under the pressure of the spring 35 on the catch 41A.

After turning about the axis or rotation A for typically about 80 degrees, the spring portions 38A has disengaged the wing 34A and has risen so far that it engages a next locking protrusion 37, halting rotation beyond 90 degrees, and resetting the rotation mechanism substantially to the starting position. The mechanism may be operated in either direction or be provided with stops or with structures defining unidirectional functionality.

The (spindle connection feature 42 of the) locking spring member 38 may impart its relatively sudden and rapid rotation to a spindle portion 9 of the switch connected to one or more rotary contacts 7, allowing fast switching and relatively short arcing time between the disengaging contacts 7, 8.

In the past, the locking spring member was made of metal to accept the mechanical loads. Insulation was provided around the metal locking spring member. The present disclosure provides an insulating portion 40 to the locking spring member 36, instead of a mere insulation layer.

Thus the locking spring member 36 is less likely to suffer from a short circuit due to a spark plume or voltage creep than a locking spring member of the prior art. The present rotation control module 3 is therefore safer. The present rotation control mechanism may inherently be less bulky than a prior art device which requires portions of different material. It thus also allows to construct the module smaller. In addition, less parts are required, allowing more cost-efficient manufacturing.

Moreover, the portion 40 itself is formed corresponding to the spindle portion or to spindle modules of the switch. At the latest from a comparison of FIGS. 7A, 7B with FIGS. 8A, 8B, the skilled person will appreciate that the switch or the modules may be inverted compared to the Figures, e.g. for mounting the switch in particular situations or apparatus. The different embodiments of the locking spring member 36 correspond to different orientations of it with respect to the spindle portion or spindle module(s) 9 to which the member 36 should connect. Further, the housing 14 of the rotation control module may be configured for mounting to an apparatus in addition to or instead of the last switch module 2 at the other end of the switch 1 (as in the switch mounting module 2A). For such a situation the housing 14 may also be formed with other fastening arrangements, e.g. in the presently shown case a suitable modification would be to formed the module with snapping latches 12 instead of windows 13.

It should be noted in this respect that, unless explicitly stated otherwise, directions mentioned in the description refer to the orientations in the Figures and should not be construed limiting the disclosure.

The teaching of the disclosure is not restricted to the above described embodiments which can be varied in a number of ways within the scope of the claims. For instance, the switch may comprise less or more switch modules.

It may also comprise other modules such as spacer modules for sizing the switch or for providing additional insulation between adjacent switch modules.

One or more switch modules may comprise more or less stationary contacts.

It is conceivable that currents are conducted through a conductive spindle or one or more conductive spindle modules.

One or more additional fasteners may be provided to the modules.

The rotary and/or stationary contacts may be shaped differently, e.g. for single-sided contacting instead of the presently shown clamping contact of the rotary contact onto the stationary contacts, the stationary contacts clamping onto the rotary contact, butt-contacting (i.e. contact faces substantially parallel to the axis A, substantially perpendicular to the presently shown embodiment) etc.

The housing of the switch need not be rectangular or square but may be round, hexagonal etc.

Any and all aspects may suitably be combined to provide an improved electrical rotary switch.

The invention claimed is:

1. Locking spring member configured for an electrical rotary switch comprising at least one rotary contact and at least one stationary contact, wherein the locking spring member comprises a first portion and a second portion, wherein the first portion comprises a resilient spring member configured for releasably engaging a locking member and the second portion is configured for mechanically coupling to a spindle portion for imparting a rotational force on at least one rotary contact of the switch, wherein the second portion is electrically insulating.

2. Electrical rotary switch comprising a housing accommodating at least a first rotary contact and a second rotary contact configured for being rotatable between a first and a second orientation about a common axis of rotation, a locking member, a spindle portion, a locking spring member comprising a first portion and a second portion, wherein the first portion comprises a resilient spring member configured for releasably engaging the locking member and the second portion is configured for mechanically coupling to the spindle portion for imparting a rotational force on at least one rotary contact of the switch, wherein the second portion is electrically insulating, and at least a first stationary contact, a second stationary contact, a third stationary contact and a fourth stationary contact, the first stationary contact comprising a contact portion configured for being contacted by the first rotary contact and comprising a connection portion for connecting to a conductor, the second stationary contact comprising a contact portion configured for being contacted by the second rotary contact and comprising a connection portion for connecting to a conductor, the third stationary contact comprising a contact portion configured for being contacted by the first rotary contact concurrently with the first stationary contact, the fourth stationary contact comprising a contact portion configured for being contacted by the second rotary contact concurrently with the second stationary contact, wherein the first and second stationary contacts are configured offset in the axial direction and the angular direction with respect to the common axis of rotation and wherein the first and second rotary contacts are configured for concurrently contacting the respective stationary contacts, in the first rotary orientation about the common axis of rotation, wherein the first and second rotary contacts disconnect the respective stationary contacts in the second rotary orientation about the common axis of rotation.

3. Electrical rotary switch comprising:

a housing for a rotary electrical switch comprising at least one rotary contact and at least one stationary contact, the at least one stationary contact comprising a contact portion configured for being contacted by the rotary contact and a connection portion for connecting to a conductor, wherein the housing comprises a rotary contact space for accommodating the rotary contact, a plurality of stationary contact spaces for selectively accommodating the at least one stationary contact, and wherein the housing comprises one or more closing elements for closing one or more of the stationary contact spaces not in use for accommodating a stationary contact.

4. Electrical rotary switch according to claim 3, comprising a plurality of rotary contacts and a modular spindle, the modular spindle comprising at least two spindle modules which are mechanically connected or connectable for each imparting a rotational force on at least one rotary contact of the switch.

5. Electrical rotary switch of claim 3, further comprising a locking member, a spindle portion, a locking spring member comprising a first portion and a second portion, wherein the first portion comprises a resilient spring member configured for releasably engaging the locking member and the second portion is configured for mechanically coupling to the spindle portion for imparting a rotational force on at least one rotary contact of the switch, and wherein the second portion is electrically insulating.

6. Housing for a rotary electrical switch comprising at least one rotary contact and at least one stationary contact, wherein the housing comprises a rotary contact space for accommodating the rotary contact, a plurality of stationary contact spaces for selectively accommodating the at least one stationary contact, and wherein the housing comprises one or more closing elements for closing one or more of the stationary contact spaces not in use for accommodating a stationary contact.

7. Housing according to claim 6, the one or more closing elements comprising an electrode.

8. Housing according to claim 6, comprising an exhaust channel in communication with the rotary contact space via an opening.

9. Housing according to claim 6, comprising an exhaust channel in communication with the rotary contact space via an opening, and further comprising an electrode, wherein at least a portion of the electrode is configured or configurable in the exhaust channel.

10. Housing according to claim 6, comprising an exhaust channel in communication with the rotary contact space via an opening, and further comprising an electrode, wherein at least one of the stationary contact spaces is substantially closed or closable by the electrode, and wherein at least a portion of the electrode is configured or configurable in the exhaust channel.

11. Housing according to claim 6, comprising an exhaust channel in communication with the rotary contact space via an opening, wherein at least one of the stationary contact spaces is configured such that a stationary contact fitting that space substantially blocks the communication between the rotary contact space and the exhaust channel.

12. Housing according to claim 6, being a first housing module for a modular housing for an electrical rotary switch, wherein the first housing module is stackable to a second housing module.

* * * * *

UNITED STATES PATENT AND TRADEMARK OFFICE

CERTIFICATE OF CORRECTION

PATENT NO. : 8,658,923 B2
APPLICATION NO. : 12/935585
DATED : February 25, 2014
INVENTOR(S) : Weber et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 535 days.

Signed and Sealed this
Twenty-ninth Day of September, 2015

Michelle K. Lee

Michelle K. Lee
*Director of the United States Patent and Trademark Office*